United States Patent [19]

Yeckley et al.

[11] 4,095,069

[45] June 13, 1978

[54] STAINLESS-STEEL INTERRUPTER-HEAD CONSTRUCTION FOR CIRCUIT-INTERRUPTERS CONTINUOUSLY CARRYING HIGH-VALUE-AMPERAGE CURRENTS

[75] Inventors: Russell N. Yeckley, Murrysville; Zeno Neri, Wilkins Township, Allegheny County, both of Pa.

[73] Assignee: Westinghouse Electric Corp., Pittsburgh, Pa.

[21] Appl. No.: 660,745

[22] Filed: Feb. 23, 1976

[51] Int. Cl.[2] ..... H01H 33/56

[52] U.S. Cl. ..... 200/148 B; 200/148 R

[58] Field of Search ..... 200/148 B, 148 R, 147 R, 200/144 B

[56] References Cited

U.S. PATENT DOCUMENTS

| | | | |
|---|---|---|---|
| 1,706,746 | 3/1929 | Rice | 200/148 B |
| 2,911,505 | 11/1959 | Legg et al. | 200/147 R |
| 3,538,276 | 11/1970 | Leeds | 200/148 R |
| 3,668,350 | 6/1972 | Takeuchi et al. | 200/144 B |
| 3,711,622 | 1/1973 | Deno | 200/147 R |
| 3,792,220 | 2/1974 | Yoshioka et al. | 200/144 B |

*Primary Examiner*—Robert S. Macon
*Attorney, Agent, or Firm*—W. R. Crout

[57] ABSTRACT

An improved interrupter-head construction is provided composed substantially entirely of a non-magnetic stainless-steel shell, and, preferably, additionally painted, or coated with a suitable coating, such as, for example, an epoxy primer coat and desirably, although not necessary, a second finish enamel coating.

6 Claims, 3 Drawing Figures

FIG.1.
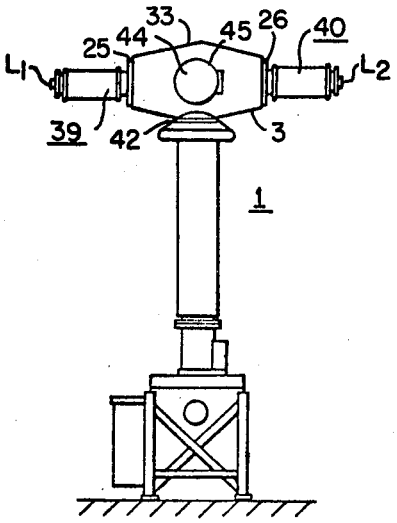
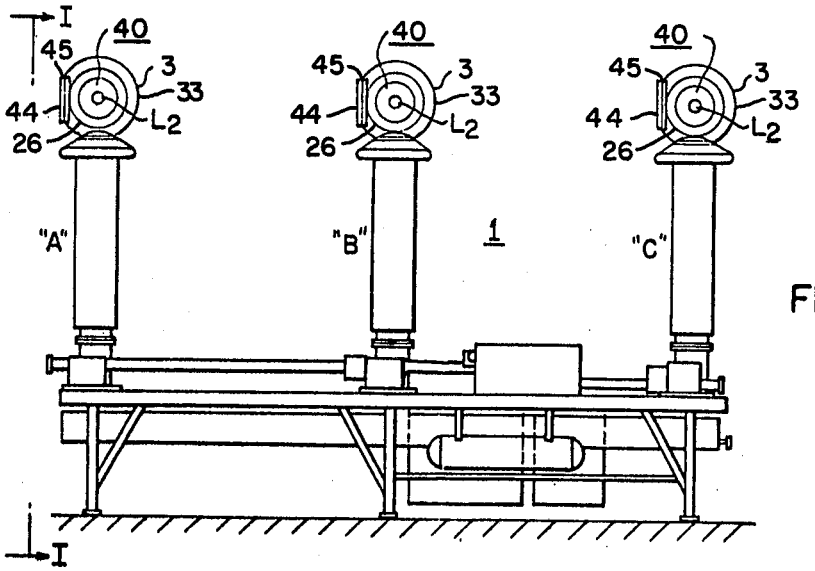
FIG.2

STAINLESS-STEEL INTERRUPTER-HEAD CONSTRUCTION FOR CIRCUIT-INTERRUPTERS CONTINUOUSLY CARRYING HIGH-VALUE-AMPERAGE CURRENTS

CROSS-REFERENCE TO RELATED APPLICATIONS

Applicants are not aware of any related patent applications pertinent to the present invention.

BACKGROUND OF THE INVENTION

In U.S. Pat. No. 3,291,947, issued Dec. 13, 1966 to R. C. Van Sickle, there is illustrated and described a high-voltage, compressed-gas circuit-interrupter involving a plurality of serially-related interrupting head-units disposed high up in the air and at high-voltage, and moreover supported by upstanding insulating hollow column structures composed of any suitable insulating material, such as epoxy resin, or ceramic, for example.

Additionally, reference may be had to U.S. Pat. No. 3,538,276, issued Nov. 3, 1970 to Winthrop M. Leeds, disclosing a compressed-gas circuit-interrupter of the aforesaid type, and also to U.S. Pat. No. 3,457,530 issued July 22, 1969 to R. C. Van Sickel for a suitable operating mechanism for such equipment.

Also, reference may be had to U.S. Pat. No. 3,327,082 issued June 20, 1967 to Roswell C. Van Sickle et al. relating to the blast-valve structure, and other details of construction, all pertaining to a high-voltage compressed-gas circuit-interrupter of the aforesaid type.

SUMMARY OF THE INVENTION

In accordance with the present invention, for adapting, and increasing the current-carrying capability of such high-voltage compressed-gas circuit-interrupters to very high continuous currents, say having a constant-current amperage value of, say 4,500 amperes, for example, substantially the entire interrupting head housing shell together with the end flange rings for the two-terminal bushings is formed of non-magnetic stainless steel to thereby reduce eddy-current and hysteresis losses, and to prevent thereby heating occurring during the passage through the circuit-interrupter of high-value amperage currents.

Additionally, we have found it desirable to provide a paint coating on the stainless-steel interrupting head unit shell to additionally provide ready transmission of generated heat to the outside atmosphere from the housing shell, and, concomitantly, providing a desirable resistance to atmospheric erosion for the metallic shell.

Finally, the conductor-studs passing through the two terminal-bushings are formed of copper for providing high-conductivity metal, and thereby enabling a minimum of generated "$I^2R$" heat during the constant passage of high-amperage currents through the circuit-interrupter.

BRIEF DESCRIPTION OF THE DRAWING

FIG. 1 is an end elevational view of a three-phase compressed-gas circuit interrupter embodying features of the present invention;

FIG. 2 is a side elevational view of the circuit-interrupter of FIG. 1; and,

DESCRIPTION OF THE PREFERRED EMBODIMENT

Figure 3:
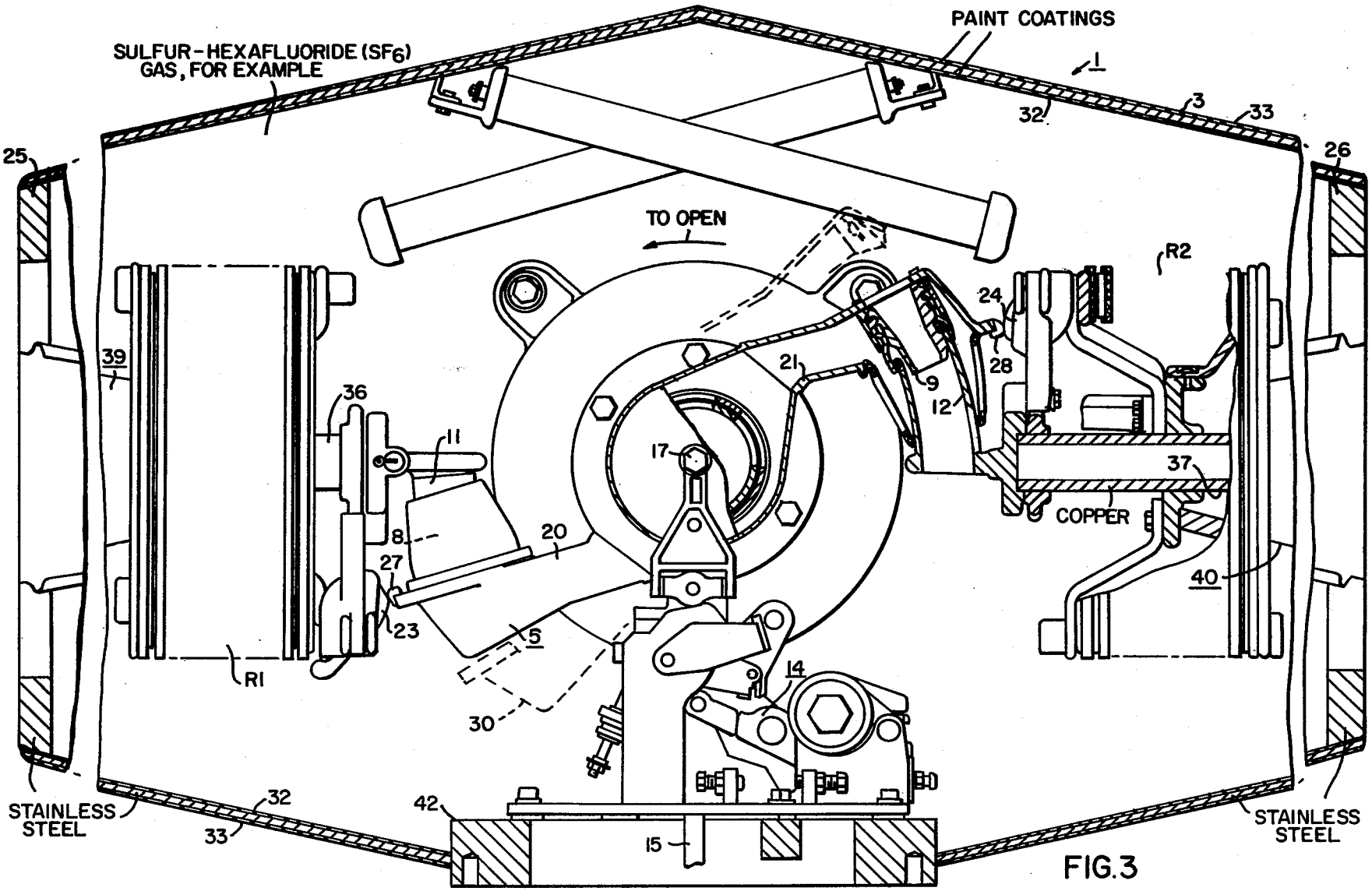
FIG. 3 is a vertical sectional view taken through an interrupting-head unit assembly, provided at the upper end of an upstanding insulating column, indicating the separable contact structure in the closed-circuit position disposed within the stainless-steel shell.

Referring to the drawings, the reference numeral 1 generally designates a high-voltage interrupting assembly having separable contacts disposed within the tank unit 3 of the high-voltage compressed-gas circuit-interrupter 1. This circuit-interrupter structure 1 may conform to the general type of compressed-gas circuit-interrupter structures set forth in U.S. Pat. Nos. 3,291,947, 3,327,082 and 3,538,276, which patents give a detailed description of the manner of compressed-gas circuit interruption within the tank shell 3.

Briefly, the method of circuit interruption is the counter-clockwise rotation of a rotatable conducting movable contact arm structure 5 having a pair of movable contacts 8 and 9 making separable contacting engagement with a pair of relatively-stationary contacts 11, 12 in the manner set forth in the aforesaid U.S. Pat. No. 3,291,947.

A suitable blast-valve construction 14 (FIG. 3), as set forth in U.S. Pat. No. 3,327,082, is synchronized with the upward opening movement of an insulating operating rod 15 to effect a release of a blast of gas along the hollow axis 17 of the movable contact-arm structure 5, and radially outwardly through the hollow movable arms 20 and 21 to be ejected into the two arcs (not shown), which are established at the ends of the rotatable movable contact-arm assemblage 5.

Relatively-stationary resistance contacts 23 and 24 are contactingly engaged during a subsequent closing operation of the circuit-interrupter 1 by movable resistance contacts 27 and 28, the latter being fixedly attached to, and movable with the rotatable movable contact-arm assemblage 5.

Thus, during the closing operation, the movable resistance contacts 27, 28 make contacting engagement with the relatively-stationary resistance contacts 23, 24, thereby inserting into series electrical circuit the two resistance assemblages "R1" and "R2" to thereby prevent voltage surges occurring on the connected electrical line $L_1$–$L_2$ (FIG. 1) in the manner, as set forth in the aforesaid U.S. Pat. No. 3,291,947—R. C. Van Sickle.

In the fully-open-circuit position of the circuit-interrupter 1, the rotatable movable contact-arm structure 5 is moved to the dotted-line position, as indicated by the reference numeral 30.

In accordance with the present invention, to adapt such a circuit-interrupting structure for passage of very-high-amperage currents, say, for example, of the order of 4,500 amperes, substantially the entire interrupting head housing shell 3 is formed of non-magnetic stainless steel together with the end flange rings 25, 26 supporting the terminal-bushings. In addition, the stainless steel housing head shell 3 is preferably coated with a suitable paint on the inside 32 and also, preferably, on the outside 33 of the shell, as set forth below:

OPERATION—CLEANING AND WASH PRIMER PAINTING SHELL 3

1. Wipe the surface to be painted with a clean cloth saturated with 1-1-1 Trichloroethane (51550 FC). The head 3 after cleaning must be free from grease and dirt.

2. Mix the wash primer by combining 1 part by volume Hughson red wash primer 9924 Part "A" with 1 part by volume Hughson Primer activator 9924 Part "B" and stir thoroughly.

3. Allow the mixed wash primer to stand for 15 minutes prior to use.

4. Methyl Ethyl Ketone (51050 AD) or Methyl Ethyl Butyl Ketone (51050 AS) may be used to adjust the mixed paint viscosity for spraying consistency.

5. Immediately after cleaning, spray the head 3 with 1 coat of mixed wash primer.

6. The head 3 must not be sprayed if it is colder than 60° F.

7. The dry film thickness of the wash primer must preferably be ¼ to ½ mil.

8. The minimum dry time for the wash primer is 1 hour at room temperature (approximately 70° F).

9. Pot life of the wash primer is 8 hours, and any mixed wash primer over 8 hours old should be scrapped.

OPERATION—PRIMER PAINTING

1. The second coat of paint is a Westinghouse gray-green epoxy primer.

2. Mix the primer by thinning approximately 5 parts by volume Westinghouse primer B5-343 (32220 KQ) with approximately 1 part by volume Xylene (51550 CP) to a Zahn Cup viscosity of 60 sec. ± 5 sec.

3. Spray the wash primed surface of the head shell 3 with 1 coat of adjusted Westinghouse primer.

4. The dry film thickness of the gray-green primer shall be 2–3 mil.

5. The minimum dry time for the primer shall be 3 hours at room temperature (approximately 70° F).

OPERATION—FINISH COAT PAINTING OF SHELL 3

1. The third coat of paint is a Westinghouse silver-gray alkyd enamel, B6-364 (32220 BR).

2. Mix the alkyd enamel by adjusting the viscosity with Xylene (51500 CP) to 60 seconds ± 5 seconds with a #2 Zahn Cup viscosimeter.

3. Spray the primed head surface 3 with 1 coat of the mixed enamel.

4. The dry film thickness of the finish enamel coat shall be 2–3 mil.

5. The minimum dry time for the finish coat shall be 3 hours at room temperature (approximately 70° F).

6. Apply a second coat of Westinghouse silver-gray alkyd enamel or any other color of Westinghouse alkyd enamel by repeating steps 1 through 4 under OPERATION—FINISH COAT PAINTING OF SHELL 3.

7. The minimum dry time for the second Westinghouse alkyd enamel finish coat on the shell 3 shall be 24 hours at room temperature (approximately 70° F).

The above procedure will be satisfactory for painting both the outside 33 and inside surfaces 32 of the stainless-steel extra-high-voltage heads 3.

By the use of stainless-steel heads 3, which, of course, are non-magnetic, eddy-current and hysteresis losses are reduced to a minimum, and thereby the continuous current flow through the circuit-interrupter 1 may be increased through the interrupter 1 without the concomitant occurrence of heavy generated heat losses.

In addition, the conductor studs 36, 37, passing through the outwardly-extending two terminal-bushings 39, 40, are formed of copper, which, being of high conductivity material, are capable of passing considerable current values without overheating.

A typical 3-phase "SFA" circuit-breaker outline is shown in FIGS. 1 and 2. This typical tank shell 3 construction has formerly been supplied for a number of years at continuous current ratings of 2,000 and 3,000 amperes 60 Hz, limited, however, to these values by the maximum permissible hot-spot temperature rise of 85° C. The need of higher-current capabilities has been indicated by the electrical utilities. In surmounting this problem, the higher currents should be achieved as simply as possible, without the complexities of forced cooling, or heat-pump applications to the equipment.

Analysis of the thermal problems determined that a major portion of the temperature rise was the result of hysteresis and eddy current losses in the formerly-used carbon-steel (magnetic steel) tank 3. The interrupter module construction 3 contains the current-carrying and interrupting elements 5 inside the steel tank 3, such that the current path is axially through the tank 3 and also the terminal-bushings 39, 40 as indicated in FIG. 1. This results in the development of losses, generated in the magnetic steel shell 3, formerly used, such that at 4,000 amperes continuous current, approximately 60° C temperature rise could be attributed to the magnetic losses in the tank shell 3 in the former constructions. With the additional heat from the $I^2R$ losses in the current path through the circuit-interrupter 1, the total temperature rise of the contacts 8, 9, 11, 12 would exceed the maximum permissible rise of 85° C.

Even is several non-magnetic sections were inserted longitudinally in the tank 3, according to the former construction, the contribution of the magnetic losses would still be approximately 30° C. The use of an austenitic steel (non-magnetic) shell 3, however, practically eliminates this generated heat loss, thus allowing the circuit-breaker 1 to carry higher continuous currents at the specified maximum rise of 85° C. As the magnetic path is now practically an air path, selected components such as the bottom flange 42, the tank door 44 and door flange 45 (FIG. 2) can be made of standard magnetic steel for the associated cost savings. The end flange mounting rings 25, 26 (FIG. 3) should, however be of stainless-steel.

Additional temperature reduction in the current-carrying parts is also achieved by painting the stainless-steel shell 3 to improve the heat transfer. Generally, the stainless-steels do not require surface finish for weather protection; however the emissivity coefficient of the stainless-steels is less than 0.2 in comparison to a black body which is 1.0. To obtain the most efficient heat transfer from the tank 3 to atmosphere, the tank 3 should be painted, as indicated and described heretofore. Most non-metallic paints have an emissivity coefficient of approximately 0.9. Special techniques are required to apply paint to the stainless-steels, as set forth above.

Recently, a temperature-rise test was made on an "SFA" module, similar to FIGS. 1–3, which incorporated the improved details described in this invention. The hot-spot temperature rise at 4,500 amps., 60 Hz was measured to be 83° C. This verified the ability of the "SFA" module 1 with the features described to carry a 4,500 amp. continuous current rating.

Although there has been illustrated and described a specific structure, it is to be clearly understood that the same was merely for the purpose of illustration, and that changes and modifications may readily be made therein by those skilled in the art, without departing from the spirit and scope of the invention.

We claim:

1. A high power, high-voltage circuit-interrupter including, in combination, means defining a high-voltage interruptering pressurized metallic head-unit capable of carrying currents in excess of 4,000 amperes, upstanding hollow insulating column means for supporting said interrupting pressurized metallic head-unit high up in the air an adequate distance and height from ground potential, a pair of terminal-bushings having terminal-studs extending interiorly within said interrupting pressurized metallic head-unit, at least a pair of separable contacts disposed interiorly within said pressurized head-unit and separable away from each other to establish an arc during the opening operation, conducting means electrically interconnecting said separable contacts with the terminal-studs extending through the pair of terminal-bushings, operating means for effecting separation of the separable contacts within said interrupting head-unit and subjecting the established arc to a blast of compressed gas to thereby effect the extinction thereof, said high-voltage interrupting metallic pressurized head-unit being composed substantially entirely of stainless-steel material, the pressurized metallic interrupting head-unit having an insulating outer surface coating provided thereon about its outside surface and also another insulating coating around its inside surface to assist in rapid heat transfer from the pressurized metallic head-unit to the outer external ambient atmosphere.

2. The combination according to claim 1, wherein said high-voltage interrupting pressurized metallic head-unit additionally has a pair of end-flange mounting rings (25, 26) associated therewith to assist in mounting the pair of terminal-bushings.

3. The combination according to claim 1, wherein at least one of said coatings comprises a layer of epoxy and an additional coating layer of enamel paint.

4. The combination according to claim 1, wherein the two terminal-studs are fabricated of copper.

5. A high-power, high -voltage circuit-interrupter including, in combination, a high-voltage interrupting pressurized metallic head-unit capable of carrying currents in excess of 4,000 amperes, upstanding hollow insulating column means or supporting said interrupting pressurized metallic head-unit high up in the air an adequate distance and height from ground potential, a pair of terminal-bushings extending interiorly within said interrupting pressurized metallic head-unit and carrying a pair of stationary contacts at their interior ends, a rotatable movable contact-arm assemblage rotatable interiorly within said pressurized metallic head-unit and having a pair of spaced movable contacts disposed at its outer ends, operating means including a linearly-movable insulating operating rod reciprocally movable within said hollow upstanding insulating column means for effecting the opening and closing rotative movements of said rotatable movable contact-arm assemblage, said high-voltage interrupting pressurized metallic head-unit being composed substantially entirely of stainless-steel material, the non-magnetic stainless-steel high-voltage interrupting pressurized metallic head-unit (3) having an insulating outer surface coating provided thereon about its outside surface and also another insulating coating around its inside surface to assist in rapid heat transfer from the head-unit (3) to the outer ambient atmosphere.

6. The combination according to claim 5, wherein said high-voltage interrupting pressurized metallic head-unit additionally has a pair of end-flange mounting rings (25, 26) associated therewith to assist in mounting the pair of terminal bushings.

* * * * *